US011754013B1

(12) United States Patent
Gwidt et al.

(10) Patent No.: US 11,754,013 B1
(45) Date of Patent: Sep. 12, 2023

(54) ENHANCED MINIMUM MASS LIMIT FOR DIRECT INJECTION ENGINES

(71) Applicant: GM GLOBAL TECHNOLOGY OPERATIONS LLC, Detroit, MI (US)

(72) Inventors: J. Michael Gwidt, Brighton, MI (US); Daniel P Himes, Detroit, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/651,656

(22) Filed: Feb. 18, 2022

(51) Int. Cl.
*F02D 41/24* (2006.01)

(52) U.S. Cl.
CPC ..... *F02D 41/2467* (2013.01); *F02D 41/2422* (2013.01); *F02D 41/2487* (2013.01); *F02D 2200/0614* (2013.01)

(58) Field of Classification Search
CPC ..... F02D 41/2467; F02D 41/2422; F02D 41/2487; F02D 2200/0614
See application file for complete search history.

(56) References Cited

U.S. PATENT DOCUMENTS 4,738,238 A * 4/1988 Ohishi ..... F02D 41/2496 123/694
5,033,437 A * 7/1991 Hori ..... F02D 41/2454 123/674
6,192,857 B1 * 2/2001 Shimada ..... F01L 13/06 477/109
6,273,056 B1 * 8/2001 Shirakawa ..... F02D 41/064 123/305
9,689,342 B2 * 6/2017 Ranga ..... F02B 3/12
2006/0074542 A1 * 4/2006 Kikutani ..... F02D 41/266 701/105
2008/0059047 A1 * 3/2008 Kokubu ..... F02D 19/061 701/103
2013/0046454 A1 * 2/2013 Cowgill ..... F02D 19/081 701/104
2015/0066335 A1 * 3/2015 Kishi ..... F02D 41/2416 701/103
2016/0069290 A1 * 3/2016 Radeczky ..... F02D 41/3076 701/22
2016/0377011 A1 * 12/2016 Carboni ..... F02D 41/2467 701/104
2017/0356380 A1 * 12/2017 Surnilla ..... F02D 13/06
2018/0347494 A1 * 12/2018 Sanborn ..... F02D 41/221
2019/0338720 A1 * 11/2019 Banker ..... F02D 41/3094

FOREIGN PATENT DOCUMENTS

WO WO-2005008050 A1 * 1/2005 ..... F02D 41/20
WO WO-2009130095 A1 * 10/2009 ..... F02D 19/084
WO WO-2010113331 A1 * 10/2010 ..... F02D 19/084
WO WO-2012086025 A1 * 6/2012 ..... F02D 41/1402
WO WO-2019145724 A1 * 8/2019 ..... F02D 19/00

* cited by examiner

*Primary Examiner* — Joseph J Dallo
(74) *Attorney, Agent, or Firm* — Lorenz & Kopf LLP

(57) ABSTRACT

In accordance with exemplary embodiments, methods and systems are provided for controlling fuel injection by a fuel injector of a direct injection engine. In one embodiment, a method includes: storing, in a first data storage device, a first table of values; storing, in a second data storage device, a second table of values; and adjusting, via instructions provided by a processor of the vehicle, a minimum mass value used to control the fuel injection based on an injector learned value, the first table, and the second table, wherein the injector learned value is set based on an amount of injector learning completed.

17 Claims, 2 Drawing Sheets

ENHANCED MINIMUM MASS LIMIT FOR DIRECT INJECTION ENGINES

INTRODUCTION

The technical field generally relates to the field of vehicles and, more specifically, to control of fuel injection in an engine of a vehicle.

Many vehicles today have drive systems that include engines, such as internal combustion engines. A direct-injection internal combustion engine (hereinafter also referred to as a direct injection engine) includes a fuel injector for each cylinder. The fuel, such as gasoline, is directly injected into a combustion chamber via the fuel injector, and mixed with intake air introduced from inlet ports into the combustion chambers to form a mixture, which can be ignited by ignition plugs. The direct-injection engine provides low fuel consumption, low emission, and high power output.

The fuel is injected according to a defined mass. The amount of fuel injected by the fuel injectors is typically limited by a minimum mass which is typically static in engine systems. Fueling errors can occur, which impacts fuel injection near the minimum mass limit. Accordingly, it is desirable to provide improved systems and methods for controlling fuel injection in direct injection engines of vehicles. Furthermore, other desirable features and characteristics of the present invention will become apparent from the subsequent detailed description of the invention and the appended claims, taken in conjunction with the accompanying drawings and this background of the invention.

SUMMARY

In accordance with an exemplary embodiment, a method is provided for controlling fuel injection by a fuel injector of a direct injection engine, the method includes: storing, in a first data storage device, a first table of values; storing, in a second data storage device, a second table of values; and adjusting, via instructions provided by a processor of the vehicle, a minimum mass value used to control the fuel injection based on an injector learned value, the first table, and the second table. The injector learned value is set based on an amount of injector learning completed.

In various embodiments, the first table is defined by a plurality of injector learned values and a plurality of mass values.

In various embodiments, the second table is defined by a plurality of injector learned values and a plurality of mass values.

In various embodiments, the adjusting the minimum mas value is based on a blend of a mass value from the first table and a mass value from the second table as a function of the injector learned value.

In various embodiments, the injector learned value is a value that ranges from zero to one, and when the injector learned value is zero, the amount of injector learning completed is none, and when the injector learned value is one, the amount of injector learning is all.

In various embodiments, when the injector learned value is zero, the minimum mass value is set to a highest mass value of a plurality of mass values.

In various embodiments, when the injector learned value is one, the minimum mass value is set to a lowest mass value of a plurality of mass values.

In another embodiment a system for controlling fuel injection by a fuel injector of a direct injection engine is provided. The system includes: a data storage device configured to store first table of values and a second table of values; and a processor configured to at least facilitate adjusting a minimum mass value used to control the fuel injection based on an injector learned value, the first table, and the second table. The injector learned value is set based on an amount of injector learning completed.

In various embodiments, the first table is defined by a plurality of injector learned values and a plurality of mass values.

In various embodiments, the second table is defined by a plurality of injector learned values and a plurality of mass values.

In various embodiments, the adjusting the minimum mas value is based on a blend of a mass value from the first table and a mass value from the second table as a function of the injector learned value.

In various embodiments, the injector learned value is a value that ranges from zero to one, and when the injector learned value is zero, the amount of injector learning completed is none, and when the injector learned value is one, the amount of injector learning is all.

In various embodiments, when the injector learned value is zero, the minimum mass value is set to a highest mass value of a plurality of mass values.

In various embodiments, when the injector learned value is one, the minimum mass value is set to a lowest mass value of a plurality of mass values.

In another embodiment, a vehicle is provided. The vehicle includes: an engine having a plurality fuel injectors; one or more sensors of the vehicle configured to sense observable conditions of the plurality of fuel injectors; and a processor that is coupled to the one or more sensors and that is configured to at least facilitate storing, in a first data storage device, a first table of values, storing, in a second data storage device, a second table of values, and adjusting, via instructions provided by a processor of the vehicle, a minimum mass value used to control the fuel injection based on an injector learned value, the first table, and the second table. The injector learned value is set based on an amount of injector learning completed.

In various embodiments, the first table is defined by a plurality of injector learned values and a plurality of mass values, and the second table is defined by a plurality of injector learned values and a plurality of mass values.

In various embodiments, the adjusting the minimum mas value is based on a blend of a mass value from the first table and a mass value from the second table as a function of the injector learned value.

In various embodiments, the injector learned value is a value that ranges from zero to one, and when the injector learned value is zero, the amount of injector learning completed is none, and when the injector learned value is one, the amount of injector learning is all.

In various embodiments, when the injector learned value is zero, the minimum mass value is set to a highest mass value of a plurality of mass values.

In various embodiments, when the injector learned value is one, the minimum mass value is set to a lowest mass value of a plurality of mass values.

DESCRIPTION OF THE DRAWINGS

The present disclosure will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding technical field, background, brief summary, or the following detailed description. As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of systems, and that the systems described herein is merely exemplary embodiments of the present disclosure.

For the sake of brevity, conventional techniques related to signal processing, data transmission, signaling, control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

Figure 1:
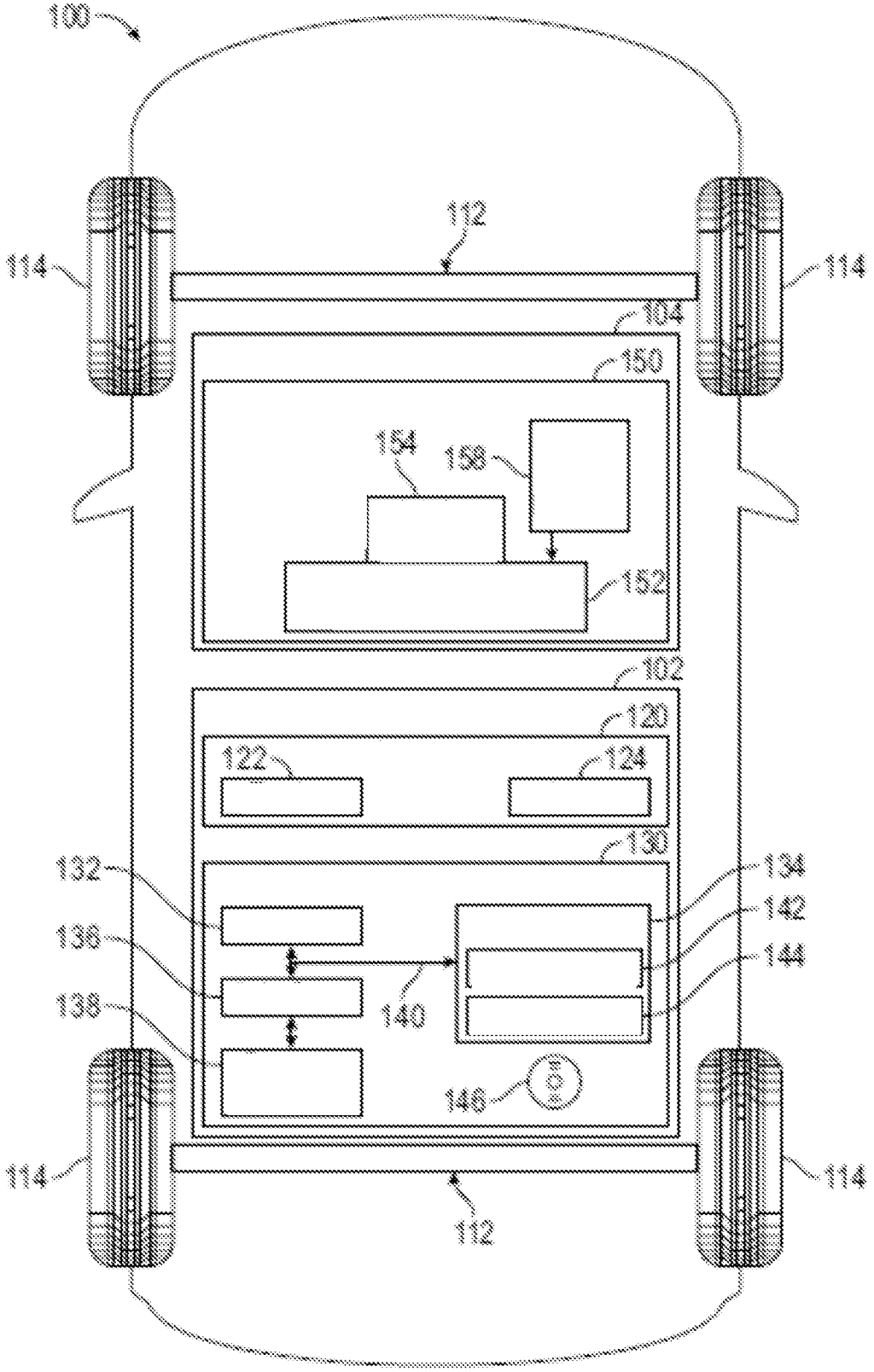
FIG. 1 is a functional block diagram of a vehicle that includes a drive system having an engine with a direct fuel injector, and a control system that is used for controlling engine the direct fuel injector in accordance with exemplary embodiments.

FIG. 1 illustrates a vehicle 100, according to an exemplary embodiment. As described in greater detail further below, the vehicle 100 includes a drive system 104 with an engine 150 having at least one direct fuel injector 158. Also as described in greater detail further below and depicted in FIG. 1, the vehicle 100 also includes a control system 102 that controls fuel injection by the direct fuel injection 158 of the engine 150 based on a minimum mass limit that is dynamically adjusted.

In certain embodiments, the vehicle 100 comprises an automobile. In various embodiments, the vehicle 100 may be any one of a number of different types of automobiles, such as, for example, a sedan, a wagon, a truck, or a sport utility vehicle (SUV), and may be two-wheel drive (2WD) (i.e., rear-wheel drive or front-wheel drive), four-wheel drive (4WD) or all-wheel drive (AWD), and/or various other types of vehicles in certain embodiments. In certain embodiments, the vehicle 100 may also comprise a motorcycle and/or one or more other types of vehicles. In addition, in various embodiments, it will also be appreciated that the vehicle 100 may comprise any number of other types of mobile platforms.

In the depicted embodiment, the vehicle 100 includes a body 110 that substantially encloses other components of the vehicle 100. Also in the depicted embodiment, the vehicle 100 includes a plurality of axles 112 and wheels 114. The wheels 114 are each rotationally coupled to one or more of the axles 112 near a respective corner of the body 110 to facilitate movement of the vehicle 100. In one embodiment, the vehicle 100 includes four wheels 114, although this may vary in other embodiments (for example for trucks and certain other vehicles).

The drive system 104 drives the wheels 114. In the depicted embodiment, the drive system 104 comprises a propulsion system, and includes the above-referenced engine 150. In various embodiments, the engine 150 comprises an internal combustion engine, such as a gasoline or diesel fueled combustion engine.

In various embodiments, the engine 150 includes a combustion chamber 152 and an intake valve 154, along with the above-referenced direct fuel injector 158. In various embodiments, the direct fuel injector 158 is directly coupled to the combustion chamber 152, and provides fuel directly to the combustion chamber 152. As can be appreciated, in various embodiments, the combustion chamber 152 is implemented as multiple combustion chambers each with direct fuel injector 158 and the intake valve based on the number of cylinders (not shown) implemented in the engine 150. Each direct fuel injector is separately controlled based on a minimum mass limit.

In various embodiments, the control system 102 provides instructions for controlling the drive system 104, including for controlling the engine 150. In various embodiments, the control system 102 comprises an engine control unit (ECU) for the engine 150. Also in various embodiments, among other functionality, the control system 102 selectively controls operation of the direct fuel injector 158, including respective ratios of fuel provided therefrom to the combustion chamber 152, to control a power output of the engine. In various embodiments, the control system 102 provides these functions in accordance with the steps of the process 200 described further below in connection with the FIG. 2.

As depicted in FIG. 1, in various embodiments, the control system 102 includes a sensor array 120 and a controller 130. In various embodiments, the sensor array 120 includes sensors for measuring sensor data. As depicted in FIG. 1, in various embodiments, the sensor array 120 includes one or more engine sensors 122. In various embodiments, the engine sensors 122 are attached to, disposed within, or otherwise disposed in proximity to the combustion chamber 152.

In certain embodiments, the sensor array 120 may also include one or more other sensors 124, for example for operation of the engine. For example, in certain embodiments, the other sensors 124 may include one or more ignition sensors for detecting when the engine 150 is turned on and/or running, and so on.

In various embodiments, the controller 130 is coupled to the sensor array 120, and provides instructions for controlling the engine 150 (including controlling fuel injection)

based on the sensor data. As depicted in FIG. 1, the controller 130 comprises a computer system. In certain embodiments, the controller 130 may also include the sensor array 120 and/or one or more other vehicle components. In addition, it will be appreciated that the controller 130 may otherwise differ from the embodiment depicted in FIG. 1. For example, the controller 130 may be coupled to or may otherwise utilize one or more remote computer systems and/or other control systems, for example as part of one or more of the above-identified vehicle devices and systems.

In the depicted embodiment, the computer system of the controller 130 includes a processor 132, a memory 134, an interface 136, a storage device 138, and a bus 140. The processor 132 performs the computation and control functions of the controller 130, and may comprise any type of processor or multiple processors, single integrated circuits such as a microprocessor, or any suitable number of integrated circuit devices and/or circuit boards working in cooperation to accomplish the functions of a processing unit. During operation, the processor 132 executes one or more programs 142 contained within the memory 134 and, as such, controls the general operation of the controller 130 and the computer system of the controller 130, generally in executing the processes described herein, such as the process 200 discussed further below in connection with FIG. 2.

The memory 134 can be any type of suitable memory. For example, the memory 134 may include various types of dynamic random access memory (DRAM) such as SDRAM, the various types of static RAM (SRAM), and the various types of non-volatile memory (PROM, EPROM, and flash). In certain examples, the memory 134 is located on and/or co-located on the same computer chip as the processor 132. In the depicted embodiment, the memory 134 stores the above-referenced program 142 along with one or more stored values 144 (e.g., including, in various embodiments, predetermined threshold values for controlling emissions of the drive system).

The bus 140 serves to transmit programs, data, status and other information or signals between the various components of the computer system of the controller 130. The interface 136 allows communications to the computer system of the controller 130, for example from a system driver and/or another computer system, and can be implemented using any suitable method and apparatus. In one embodiment, the interface 136 obtains the various data from the sensor array 120, the drive system 104, the drive system 104, and/or one or more other components and/or systems of the vehicle 100. The interface 136 can include one or more network interfaces to communicate with other systems or components. The interface 136 may also include one or more network interfaces to communicate with technicians, and/or one or more storage interfaces to connect to storage apparatuses, such as the storage device 138.

The storage device 138 can be any suitable type of storage apparatus, including various different types of direct access storage and/or other memory devices. In one exemplary embodiment, the storage device 138 comprises a program product from which memory 134 can receive a program 142 that executes one or more embodiments of one or more processes of the present disclosure, such as the steps of the process 200 and the tables (Table T and Table L) discussed further below in connection with FIG. 2. In another exemplary embodiment, the program product may be directly stored in and/or otherwise accessed by the memory 134 and/or one or more other disks 146 and/or other memory devices.

The bus 140 can be any suitable physical or logical means of connecting computer systems and components. This includes, but is not limited to, direct hard-wired connections, fiber optics, infrared and wireless bus technologies. During operation, the program 142 is stored in the memory 134 and executed by the processor 132.

It will be appreciated that while this exemplary embodiment is described in the context of a fully functioning computer system, those skilled in the art will recognize that the mechanisms of the present disclosure are capable of being distributed as a program product with one or more types of non-transitory computer-readable signal bearing media used to store the program and the instructions thereof and carry out the distribution thereof, such as a non-transitory computer readable medium bearing the program and containing computer instructions stored therein for causing a computer processor (such as the processor 132) to perform and execute the program. Such a program product may take a variety of forms, and the present disclosure applies equally regardless of the particular type of computer-readable signal bearing media used to carry out the distribution. Examples of signal bearing media include recordable media such as floppy disks, hard drives, memory cards and optical disks, and transmission media such as digital and analog communication links. It will be appreciated that cloud-based storage and/or other techniques may also be utilized in certain embodiments. It will similarly be appreciated that the computer system of the controller 130 may also otherwise differ from the embodiment depicted in FIG. 1, for example in that the computer system of the controller 130 may be coupled to or may otherwise utilize one or more remote computer systems and/or other control systems.

Figure 2:
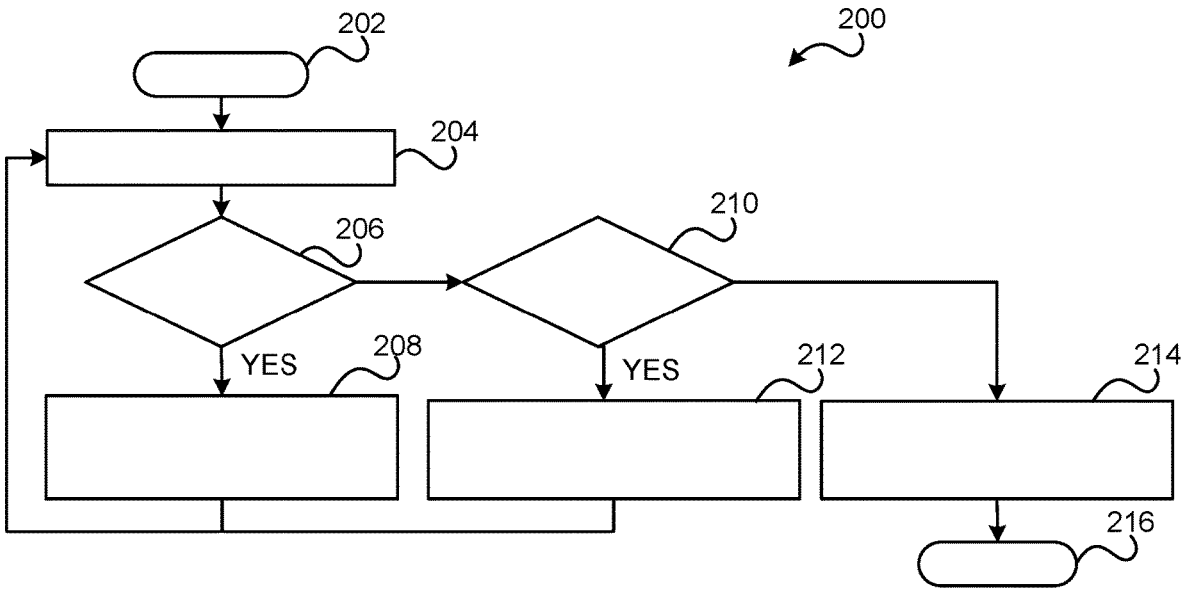
FIG. 2 is a flowchart of a process for controlling fuel injection based on a dynamic minimum mass, and that can be implemented in connection with the vehicle and control system of FIG. 1 in accordance with exemplary embodiments.

With reference now to FIG. 2, a flowchart illustrates a process 200 for controlling fuel injection of the engine system of FIG. 1 in accordance with exemplary embodiments. In various embodiments, the process 200 may be implemented in connection with the vehicle 100 of FIG. 1, including the drive system 104, the engine 150, and the control system 102 thereof.

As depicted in FIG. 2, the process 200 may begin at 202. In certain embodiments, the process 200 begins when one or more events occur to indicate that a vehicle drive is taking place or about to take place, such as a driver, operator, or passenger entering the vehicle 100, an engine or motor of the vehicle 100 being turned on, a transmission of the vehicle 100 being placed in a "drive" mode, or the like. In various embodiments, the event(s) triggering the starting of the process 200 are determined based on sensor data from one or more of the other sensors 124 of FIG. 1 (e.g., from ignition sensors in certain embodiments). Also in certain embodiments, the control system 102 is turned on, or "woken up" as part of step 202.

Thereafter, an injector learned value (IC) is obtained at 204. Injector learning compares the electric signal of the injector with a nominal injector to learn errors in the injection process. The injector learned value (IC) is set to a value between 0 and 1 based on the amount of learning completed. For example, the IC is set to 0 when no learning has been performed; the IC is set to 1 when the learning is complete; and the IC is set to values between 0 and 1 based on the amount of learning completed.

The injector learned value is evaluated in order to dynamically determine the minimum mass value. For example, at 206, when the injector learned value indicates injector learning has not taken place, the minimum mass value is set to a highest limit, for example a limit from the first table (Table T) at 208. The minimum mass value is then used by the control system to control fuel injection by the direct fuel injector 158.

Thereafter, the method 200 continues with obtaining the injector learned value at 204. Once the injector learned value indicates that learning has started, for example the IC is not set to zero but is not equal to one at 210, the minimum mass value is then set to a blend between a value from the first table (Table T) and a value from a second table (Table L) as function of the value of the injector learning at 212. The minimum mass value is then used by the control system to control fuel injection by the direct fuel injector 158.

The method 200 continues to update the minimum mass value based on updated injector learned values until it is determined that the injector is fully learned at 210 where the injector learned value is one.

Thereafter, the minimum mass value is set to the lower limit value from the second table (Table L). The minimum mass value is then used by the control system to control fuel injection by the direct fuel injector 158. The method may end at 216.

Accordingly, methods and systems, are provided for controlling fuel injection in direct injection engines in vehicles. In various embodiments, the disclosed methods and systems provide for providing dynamically adjusted minimum mass values used in controlling fuel injection. Such methods and systems allow the minimum mass to start higher on an unlearned system, to optimize misfire or emissions and end at a much lower minimum mass once the injector compensation is fully learned, improving fuel economy and particulate emissions. It will be appreciated that the systems, vehicles, applications, and implementations may vary from those depicted in the Figures and described herein. For example, in various embodiments, the vehicle 100, control system 102, drive system 104, engine 150, components thereof, and/or other components may differ from those depicted in FIG. 1 and/or described above in connection therewith. It will also be appreciated that the steps of the process 200 may differ, and/or that various steps thereof may be performed simultaneously and/or in a different order, than those depicted in FIG. 2 and/or described above.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method for controlling fuel injection by a fuel injector of a direct injection engine, the method comprising:

storing, in a first data storage device, a first table of values;

storing, in a second data storage device, a second table of values;

blending, via instructions provided by a processor of the vehicle, a mass value from the first table and a mass value from the second table as a function of an injector learned value to obtain a result; and adjusting, via instructions provided by the processor of the vehicle, a minimum mass value used to control the fuel injection based on the result, wherein the injector learned value is set based on an amount of injector learning completed.

2. The method of claim 1, wherein the first table is defined by a plurality of injector learned values and a plurality of mass values.

3. The method of claim 1, wherein the second table is defined by a plurality of injector learned values and a plurality of mass values.

4. The method of claim 1, wherein the injector learned value is a value that ranges from zero to one, and wherein when the injector learned value is zero, the amount of injector learning completed is none, and wherein when the injector learned value is one, the amount of injector learning is all.

5. The method of claim 4, wherein when the injector learned value is zero, the minimum mass value is set to a highest mass value of a plurality of mass values.

6. The method of claim 4, wherein when the injector learned value is one, the minimum mass value is set to a lowest mass value of a plurality of mass values.

7. A system for controlling fuel injection by a fuel injector of a direct injection engine, the system comprising:

a data storage device configured to store first table of values and a second table of values; and a processor configured to at least facilitate blending a mass value from the first table and a mass value from the second table as a function of an injector learned value to obtain a result, and adjusting a minimum mass value used to control the fuel injection based on the result, wherein the injector learned value is set based on an amount of injector learning completed.

8. The system of claim 7, wherein the first table is defined by a plurality of injector learned values and a plurality of mass values.

9. The system of claim 7, wherein the second table is defined by a plurality of injector learned values and a plurality of mass values.

10. The system of claim 7, wherein the injector learned value is a value that ranges from zero to one, and wherein when the injector learned value is zero, the amount of injector learning completed is none, and wherein when the injector learned value is one, the amount of injector learning is all.

11. The system of claim 10, wherein when the injector learned value is zero, the minimum mass value is set to a highest mass value of a plurality of mass values.

12. The system of claim 10, wherein when the injector learned value is one, the minimum mass value is set to a lowest mass value of a plurality of mass values.

13. A vehicle comprising:

an engine having a plurality fuel injectors;

one or more sensors of the vehicle configured to sense observable conditions of the plurality of fuel injectors; and a processor that is coupled to the one or more sensors and that is configured to at least facilitate storing, in a first data storage device, a first table of values, storing, in a second data storage device, a second table of values a mass value from the first table and a mass value from the second table as a function of an injector learned value to obtain a result, and adjusting a minimum mass value used to control the fuel injection based on the result, wherein the injector learned value is set based on an amount of injector learning completed.

14. The vehicle of claim 13, wherein the first table is defined by a plurality of injector learned values and a plurality of mass values, and wherein the second table is defined by a plurality of injector learned values and a plurality of mass values.

15. The vehicle of claim 13, wherein the injector learned value is a value that ranges from zero to one, and wherein when the injector learned value is zero, the amount of injector learning completed is none, and wherein when the injector learned value is one, the amount of injector learning is all.

16. The vehicle of claim 15, wherein when the injector learned value is zero, the minimum mass value is set to a highest mass value of a plurality of mass values.

17. The vehicle of claim 16, wherein when the injector learned value is one, the minimum mass value is set to a lowest mass value of a plurality of mass values.

* * * * *